United States Patent [19]

Tachida et al.

[11] Patent Number: 4,593,594

[45] Date of Patent: Jun. 10, 1986

[54] HOUSING FOR UPRIGHT PIANOS

[75] Inventors: Hiroki Tachida; Takane Sato; Shigeaki Sato, all of Shizuoka, Japan

[73] Assignee: Nippon Gakki Seizo Kabushiki Kaisha, Japan

[21] Appl. No.: 633,858

[22] Filed: Jul. 24, 1984

[30] Foreign Application Priority Data

Jul. 27, 1983 [JP] Japan ..... 58-137067

[51] Int. Cl.[4] ..... G10C 3/04

[52] U.S. Cl. ..... 84/185; 84/431

[58] Field of Search ..... 84/177, 184, 185, 186 R, 84/430, 431, 432

[56] References Cited

U.S. PATENT DOCUMENTS 464,993 12/1891 Reed ..... 84/430

2,486,338 10/1949 Sperry et al. ..... 84/430 X 2,501,641 3/1950 Cline ..... 84/186

3,262,350 7/1966 Johnson ..... 84/177

4,376,402 3/1983 Helpinstill, II ..... 84/431 X

*Primary Examiner*—L. T. Hix

*Assistant Examiner*—Brian W. Brown

*Attorney, Agent, or Firm*—Lerner, David, Littenberg, Krumholz & Mentlik

[57] ABSTRACT

In the construction of a housing for upright pianos, as a substitute for the conventional hard, thick and heavy wooden boards associated with back posts vulnerable to circumstantial changes, soft, thin and light wooden boards are attached to a metallic skelton of a substantially rectangular construction suited for supporting a keyboard assembly. Weight of the housing is greatly reduced without impairing strength and no use of back posts makes the housing well durable against changes in environmental factors.

8 Claims, 10 Drawing Figures

HOUSING FOR UPRIGHT PIANOS

BACKGROUND OF THE INVENTION

The present invention relates to a housing for upright pianos, and more particularly relates to an improvement in construction of an upright piano housing adapted for mounting a keyboard assembly and other related parts.

As later described in more detail, the housing of a conventional upright piano is made up of a number of boards made of hard and thick wooden plate. The conventional housing further includes a pair of sturdy and thick back posts to sustain the weight of a piano plate and a soundboard arranged within the housing.

With recent shortage in supply of natural resources, it has become very difficult to expect abundant supply of hard woods. Consequently, use of hard and thick woods for the housing causes inevitable rise in production cost of upright pianos. Further, use of such hard and thick boards for the housing results in a heavy construction of the upright piano quite unsuited for transportation.

Use of the wooden back posts tends to cause an additional trouble. These back posts are quite susceptible to changes in environmental factors such as temperature and humidity. They after warp and/or develop cracks when these factors change. Development of warp on the back posts causes corresponding deformation of the key bed, which in turn brings the action assemblies quite out of order. Thus, use of the wooden back posts is liable to pose ill influence on generation of musical tones.

SUMMARY OF THE INVENTION

It is the basic object of the present invention to provide a significantly light weight construction of an upright piano housing which is yet well durable against various pressure application.

It is another object of the present invention to produce an upright piano housing without use of costy hard woods.

It is yet another object of the present invention to release an upright piano housing from the ill influence to be caused by use of wooden back posts.

In accordance with the present invention, a metallic skelton of a substantially rectangular solid construction adapted for supporting a keyboard assembly is covered with significantly thin wooden boards to form a light weight but sturdy housing for an upright piano or the like.

DESCRIPTION OF PREFERRED EMBODIMENTS

Figure 1:
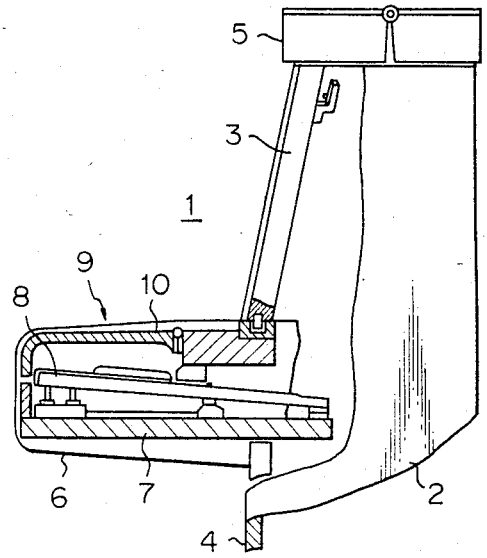
Fig. 1 PRIOR ART
FIG. 1 is a side view, partly in section, of the typical construction of a conventional upright piano.

One general example of the housing on a conventional upright piano is shown in FIG. 1, in which the housing 1 includes a pair of side boards 2, an upper front board 3, a lower front board 4, a top board 5, a bottom board not shown in the drawing, and a back board. A pair of side arms 6 are arranged extending horizontally forwards from the front face of the housing in order to support a transverse key bed 7 between them. A keyboard assembly 9 having a number of juxtaposed keys 8 is mounted on the key bed 7. Though not shown in the drawing, the housing encases action assemblies, strings each hit by an associated action assembly, a piano plate on which the strings are arranged under tension, a soundboard for amplifying vibrations of the strings and back posts for supporting the piano plate and the soundboard. As briefly mentioned above, the boards making up the housing 1 are all made of hard and thick woods of large specific gravity, and, as a consequence, the housing in general has a very heavy construction.

Figure 2:
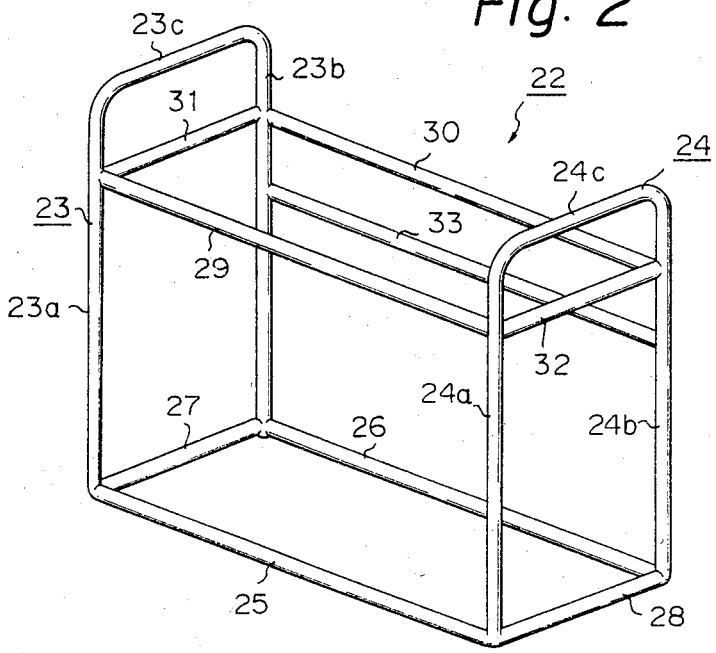
FIG. 2 is a perspective view of one embodiment of the metallic skelton used for the housing in accordance with the present invention.

Use of a metallic skeleton for an upright piano housing is the heart of the present invention, and one embodiment of such a metallic skeleton is shown in FIG. 2. The metallic skeleton 22 is made up of a plurality of metallic pipes connected at their ends to each other by, for example, welding. Preferably, the pipes have substantially circular, hollow cross sections. More specifically, the metallic skeleton 22 includes a pair of side posts 23 and 24 of a same construction each of which has an upper horizontal section 23C or 24C, and a pair of front and rear vertical sections **23*a* and 23*b*, or 24*a* and 24*b***.

Front lower ends of the side posts 23 and 24 are connected to each other by a lower front transverse bar 25 whereas rear lower ends of the side posts 23 and 24 are connected to each other by a lower rear transverse bar 26. Near upper front ends, the side posts 23 and 24 are connected to each other by an upper front transverse bar 29. In a similar way, the side posts 23 and 24 are connected to each other by an upper rear transverse bar 30. Further, at a position somewhat below the upper rear transverse bar 30, the side posts 23 and 24 are connected to each other by a middle rear transverse bar 33.

Front and rear lower ends of the side post 23 are connected to each other by a lower span bar 27 and, in a similar way, front and lower rear ends of the side post 24 are connected to each other by a lower span bar 28. At the level of the upper front and rear transverse bars 29 and 30, the front and rear vertical sections **23*a* and 23*b* of the side post 23 are connected to each other by an upper span bar 31. At the same level, the front and rear vertical sections 24*a* and 24*b* of the side post 24 are connected to each other by an upper span bar 32**.

Figure 3:
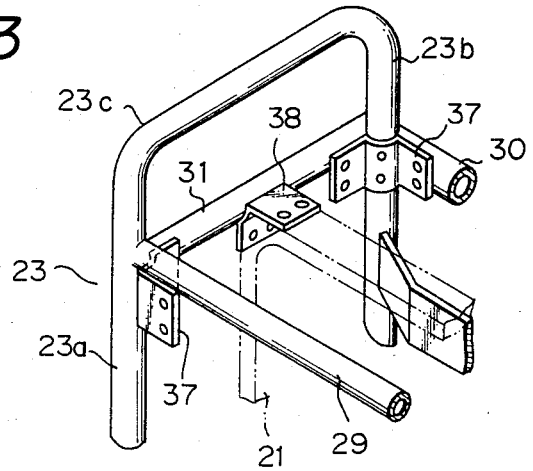
FIG. 3 is a fragmentary perspective view for showing junctions between a side post and transverse bars and a piano plate in the housing in accordance with the present invention.
Figure 4:
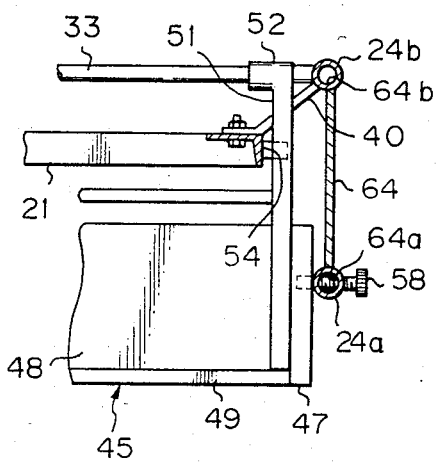
FIG. 4 is a plan view for showing couplings between the piano plate, a side board, a transverse bar and a side post in the housing in accordance with the present invention.

As shown in FIG. 3, junctions between the side posts 23, 24 and the bars 29 to 33 are fortified by metal attachments 37. Further, piano plate holders 38 are attached about the middles of the span bars 27, 28, 31 and 32 so that a rectangular piano plate 21 should be fixed to the metallic skeleton 22 at its four corners via the holders 38. In the drawing, the rectangular piano plate 21 is shown with two-dot lines. Further, as shown in FIG. 4, side ends of the rectangular piano plate 21 are fixed to the rear vertical sections 23*b* and 24*b* of the side posts 23, 24 via holder straps 40.

Figure 6:
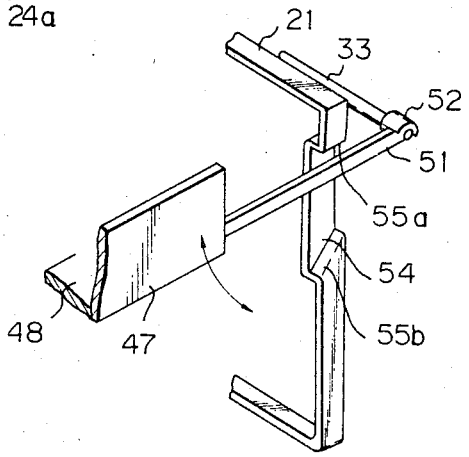
FIG. 6 is a fragmentary perspective view of a swingable supporting construction for the keyboard assembly in the housing in accordance with the present invention.
Figure 5:
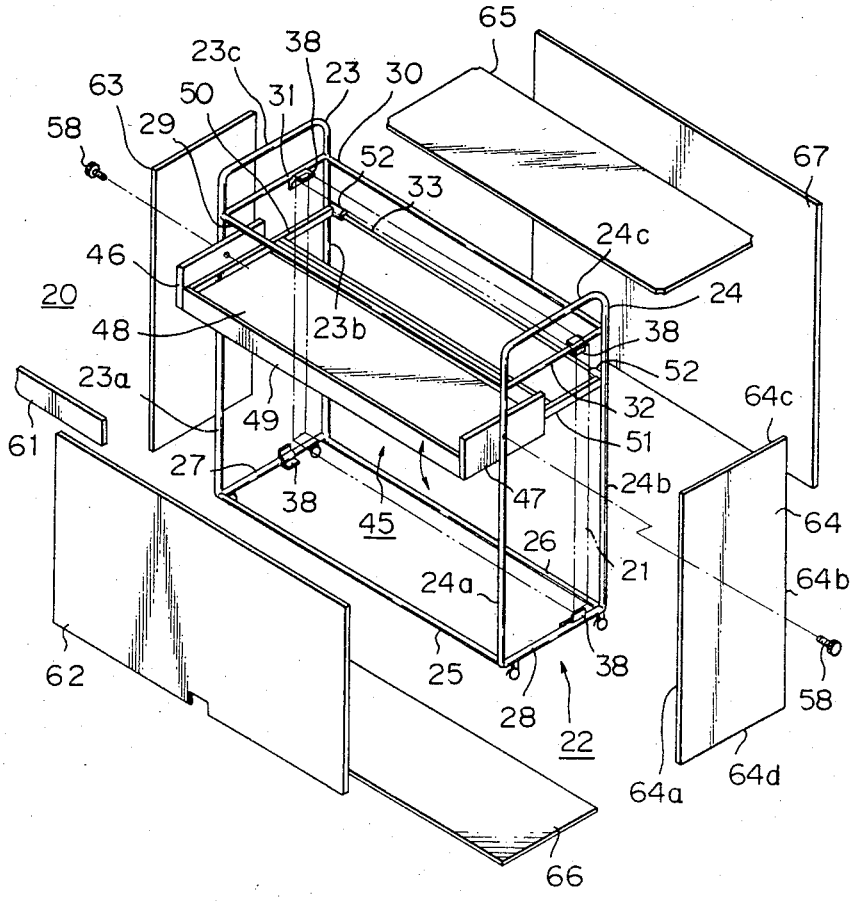
FIG. 5 is a perspective view, in a disassembled state, of the housing in accordance with the present invention.

The entire construction of the upright piano housing in accordance with the present invention is shown in FIG. 5 in a disassembled state. In addition to the above-described metallic skeleton 22 and rectangular piano plate 21, the housing 20 further includes a replaceable keyboard assembly 45, which includes a pair of side arms 46 and 47, a key bed 48 extending horizontally between the side arms 46 and 47, a key slip 49 arranged on the front end of the key bed 48, a keyboard lid not shown in the drawing and a pair of holder arms 50 and 51 extending horizontally rearwards from the rear inside ends of the side arms 46 and 47. As best seen in FIG. 6, the rear end of each holder arm 50 or 51 is provided with a bearing 52 having a semi-circular cross section which opens downwards. By means of the bearings 52, the holder arms 50 and 51 are swingably mounted at their rear ends to the middle rear transverse bar 33 to the metallic skelton 22. As a consequence, the keyboard assembly 45 is swingably mounted at its rear end to the metallic skeleton 22. When set to the horizontal position, the front section of the keyboard assembly 45 projects forwards from the housing 20 and, when swing downwards, the keyboard assembly 45 is fully accommodated within the housing 20. In order to limit this swing of the keyboard assembly 45, a depression 54 is formed in each side section of the rectangular piano plate 21 as shown in FIG. 6. More specifically, the depression 54 has upper and lower stoppers 55*a* and 55*b* for contact with the holder arm 50 and 51 so that the upper stopper 55*a* should limit the horizontal projecting position of the keyboard assembly 45 and the lower stopper should limit the inclined accommodated position of the keyboard assembly 45. As a substitute for the depression 54, an L-shaped block may be properly mounted to each side sections of the rectangular piano plate 21. For stable horizontal position of the keyboard assembly 45, set screws 58 may be preferably screwed into the side arms 46 and 47 of the keyboard assembly 45 through front vertical sections 23*a* and 24*a* of the side posts 23 and 24.

Six sides of the metallic skeleton are covered with an upper front board 61, a lower front board 62, a pair of side boards 63 and 64, a top board 65, a bottom board 66 and a rear board 67. Side and upper ends of the upper front board 61 are secured via proper set screws to the metal attachments 37 mounted to the front vertical sections 23*a* and 24*a* of the side posts 23 and 24 and to the upper front transverse bar 29. In this way, the upper front board 61 covers a gap between the upper front transverse bar 29 and the keyboard assembly 45.

Side and lower ends of the lower front board 62 are secured via proper set screws to metal attachments (not shown) mounted to the front vertical sections 23*a* and 24*a* of the side posts 23 and 24 and to the lower front transverse bar 25. In this way, the lower front board 62 covers a gap between the lower front transverse bar 25 and the keyboard assembly 45. This lower front board 62 needs to be removed when the keyboard assembly 45 is to be accommodated in the housing 20 by its downward swing about the middle rear transverse bar 33. In order to avoid this trouble, the lower front board 62 may be swingably attached to the metallic skelton 22 by means of proper hinges.

The side board 63 covers a gap between the upper and lower span bars 31 and 27 whereas the side board 64 covers a gap between the upper and lower span bars 32 and 28. Ends of the side boards 63 and 64 are secured to the metal attachments 37 and the piano plate holders 38 on the side posts 23 and 24, the upper span bars 31 and 32, and the lower span bars 27 and 28, respectively. The side boards 63 and 64 may be directly attached to the sides of the rectangular piano plate 21.

The top board 65 covers a gap between the upper spans 31 and 32. Ends of the top board 65 are secured via set screws to the metal attachments 37 and the holders 38 on the bars 29 to 31. As a substitute for the above-described screw setting, proper hings may be used for making the top board 65 partly open by swing when necessary.

The bottom board 66 covers a gap between the lower span bars 27 and 28. Ends of the bottom board 66 are secured to metal attachments (not shown) and the holders 38 on the bars 25 to 28. The rear board 67 covers a gap between the upper and lower transverse bars 30 and 26. Ends of the rear board 67 are secured via set screws to the metal attachments 37 on the side posts 23 and 24 and the bars 30 and 26.

The above-described boards 61 and 67 are mounted to the associated posts and bars without their ends being visibly exposed. Taking the side board 64 shown in FIG. 4 for example, front and rear ends 64*a* and 64*b* of the side board 64 are brought into close contact with the peripheries of the front and rear vertical sections 24*a* and 24*b* of the side post and its upper and lower ends 64*c* and 64*d* are brought into close contact with the peripheries of the upper and lower span bars 32 and 28. The upper horizontal sections 23*c* and 24*c* of the side posts 23 and 24 project outside the housing 20 whilst operating as a sort of handles and decrations.

Figure 7A:
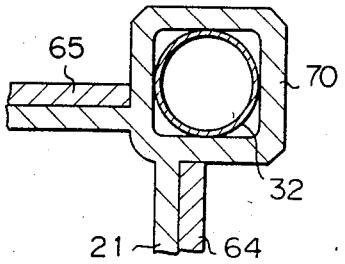
FIGS. 7A to 7C are side views, partly in section, of various couplings between the piano plate, the bar, and the boards in the housing in accordance with the present invention.
Figure 7B:
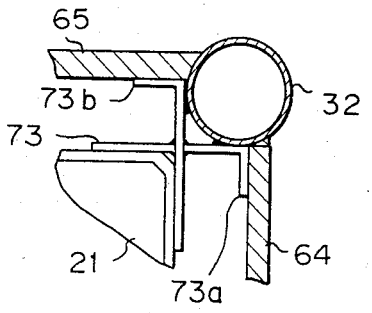
Figure 7C:
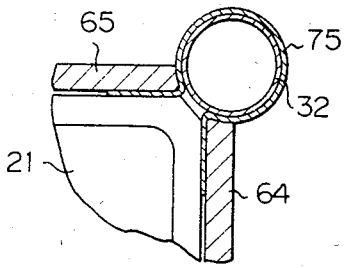

Supporting constructions of the rectangular piano plate 21 by the associated bars are shown in FIGS. 7A to 7C taking the upper span bar 32 for example. In the case of the supporting construction shown in FIG. 7A, a sleeve 70 is monolithically formed at the corner of the rectangular piano plate 21 which is inserted over the upper span bar 32. The side board 64 and the top board 65 are both directly secured to the side and upper faces of the rectangular piano plate 21.

In the case of the supporting construction shown in FIG. 7B, a cross-shaped fixer 73 is secured to the corner of the rectangular piano plate 21, which is secured to the upper span bar 32 via welding. Bent ends 73*a* and 73*b* of the fixer 73 securedly bear the associated ends of the side and top boards 64 and 65.

In the case of the supporting construction shown in FIG. 7C, the corner of the rectangular piano plate 21 is secured to the upper span bar 32 by a thin metal strap 75 and the side and top boards 64 and 65 are secured directly to the side and upper faces of the rectangular piano plate 21.

Although circular pipes are used for the posts and bars in the above-described embodiments, rectangular pipes may be used for same purposes for better face-to-face contact with associated boards.

Figure 8:
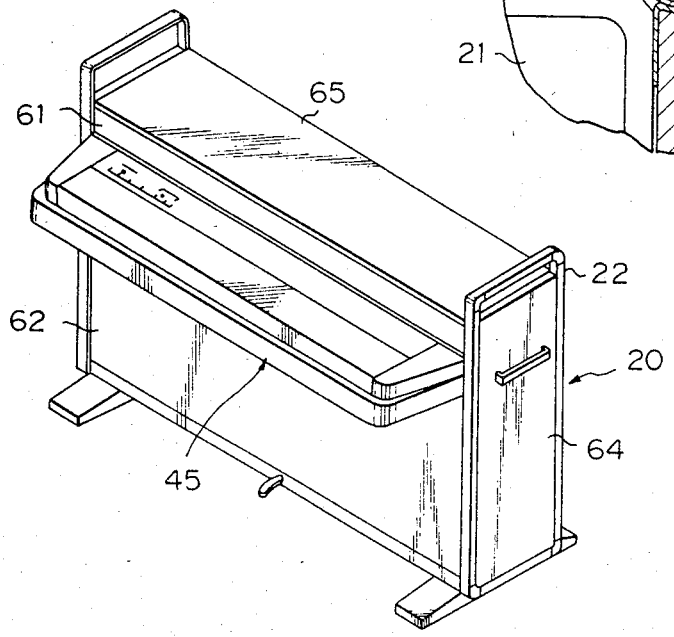
FIG. 8 is a perspective view, in the assembled state, of the housing in accordance with the present invention.

The assembled state of the upright piano housing in shown in FIG. 8. Although the foregoing description is focussed on application to non-electric type upright pianos, the present invention may also be applied to electric or electronic type upright pianos with minor modification which is quite clear to ones skilled in the art.

According to the present invention, the metallic skelton has a sturdy construction well durable against force application in various directions without any significant plastic deformation. It also has an ideal shape stability to reliably sustain the heavy rectangular piano plate 21. Being sustained by the metallic skelton, the piano plate 21 imposes no weight on the bottom board 66 which, as a consequence, may be made of a soft and thin wooden plate. Inasmuch as the metallic skelton 22 incurs most pressures acting on the piano, the boards 61 to 66 may also be made of soft and/or thin wooden plates. These all concur to reduce the weight of the housing 20. Removal of the conventional back posts allows a compact size of the piano and avoids troubles otherwise caused by deformation of the back posts. Such deformation in the back post caused by changes in environmental conditions connects to corresponding deformation in the key bed whilst causing serious disorder in the keyboard assembly. Such disorder in the keyboard assembly is inevitably accompanied with irregular hit of the strings by the hammers, which disenables correct and uniform tone generation. Removal of the back posts in accordance with the present invention avoids all troubles of this sort.

Further, since ends of the boards are all hidden invisibly by the posts and bars of the metallic skeleton 22, it is no longer necessary to cover the outer faces of the housing with decoration papers and/or panels.

Although a single metallic skeleton 22 is used for the housing 20 in the case of the illustrated embodiments, a pair of larger and smaller metallic skeltons may be used in a similar combination for higher fortification. The keyboard assembly 45 may be securedly coupled to the metallic skeleton when a simpler construction is more appreciated than compact accommodation.

We claim:

1. A housing for upright pianos comprising at least one metallic skeleton of a substantially rectangular solid construction, a keyboard assembly mounted between a pair of spaced-apart holder arms pivotally attached to said metallic skeleton, said holder arms adapted for swinging said keyboard assembly between a horizontal position projecting forward from said housing and an inclined position fully accommodated within said housing, a piano plate vertically supported within said metallic skeleton and having a side section adjacent at least one of said holder arms, a plurality of boards covering gaps in said metallic skeleton, and limiting means provided on said side section of said piano plate for limiting the pivotal movement of said keyboard assembly between said horizontal and inclined positions by engagement within said one of said holder arms.

2. A housing according to claim 1 in which said metallic skeleton is made up of a plurality of metallic pipes connected to each other at their ends.

3. A housing according to claim 2 in which said metallic pipes include a pair of side posts spaced from each other, each including front and rear vertical sections and an upper horizontal section, lower front and rear transverse bars connected at their ends to the lower ends of said side posts, upper front and rear transverse bars connected at their ends to sections of said side posts near said upper horizontal sections, lower span bars connected at their ends to the lower ends of said side posts, upper span bars connected at their ends to said side posts at about the level of said upper front and rear bars, and a middle rear transverse bar connected at its end to said rear vertical sections of said side posts at a level somewhat below said upper rear transverse bar.

4. A housing according to claim 3 in which said plurality of boards include an upper front board covering a gap between said upper front transverse bar and said keyboard assembly, a lower front board covering a gap between said lower front transverse bar and said keyboard assembly, a pair of side board covering gaps between said upper and lower span bars, a top board covering a gap between said upper span bars, and a bottom board covering a gap between said lower span bars.

5. A housing according to claim 4 in which said plurality of boards further includes a rear board covering a gap between said upper and lower rear transverse bars.

6. A housing according to claim 1 in which said limiting means comprises a depression formed in said side section of said piano plate, said depression providing an upper stop and a lower stop for limiting the pivotal movement of said keyboard assembly between said horizontal and inclined positions.

7. A housing according to claim 6 in which said upper stop comprises a horizontal lip formed in said side section of said piano plate.

8. A housing according to claim 7 in which said lower stop comprises an inclined lip formed in said side section of said piano plate.

* * * * *